US006474525B1

(12) United States Patent
Reitano

(10) Patent No.: US 6,474,525 B1
(45) Date of Patent: Nov. 5, 2002

(54) PILL SPLITTER FOR COMPLEX PILL FORMS

(76) Inventor: Carmen T. Reitano, 192 N. End Blvd., Salisbury, MA (US) 01952

( * ) Notice: Subject to any disclaimer, the term of this patent is extended or adjusted under 35 U.S.C. 154(b) by 0 days.

(21) Appl. No.: 10/145,950

(22) Filed: May 15, 2002

(51) Int. Cl.[7] ..... B26F 3/00
(52) U.S. Cl. ..... 225/1; 30/120.2; 225/89
(58) Field of Search ..... 225/89, 1; 30/120.2, 30/185, 241

(56) References Cited

U.S. PATENT DOCUMENTS 1,094,698 A * 4/1914 Bostrom ..... 30/120.2
2,655,259 A 10/1953 Davoren
3,517,871 A 6/1970 Gafney
4,173,826 A 11/1979 Leopoldi et al.
4,179,806 A 12/1979 Lieptz
4,473,192 A 9/1984 Urban et al.
5,118,021 A 6/1992 Fiocchi
5,944,243 A 8/1999 Weinstein

* cited by examiner

*Primary Examiner*—Douglas D. Watts
(74) *Attorney, Agent, or Firm*—Mark P. White

(57) ABSTRACT

A pill splitter for use with pills of complex shapes has a bed which substantially conforms to one-half of the pill. The bed is affixed within the cylindrical lower body of the splitter, into which a blade is affixed. A clearance slot allows the blade to be exposed within the bed at a height such that the pill, when placed in the bed, just touches the blade. A plunger containing guides is inserted in the cylindrical upper body, so that the plunger lies on the upper surface of the pill, along a line directly above the blade. A sharp blow to the cap of the plunger drives the pill onto the blade below, splitting the pill.

8 Claims, 5 Drawing Sheets

PILL SPLITTER FOR COMPLEX PILL FORMS

DESCRIPTION RELATIVE TO THE PRIOR ART

Pill splitters are well known in the prior art, have been in existence for many years. Examples are found in U.S. Patent Nos. U.S. Pat. No. 05,944,243, U.S. Pat. No. 02,655,259, U.S. Pat. No. 03,517,871, U.S. Pat. No. 04,173,826 , U.S. Pat. No. 04,179,806, U.S. Pat. No. 04,473,192, and U.S. Pat. No. 05,118,021. The devices described therein, as well as the other pill splitters currently available, perform a valuable function. The amount of medication required by individuals varies widely, and the dosage provided by pharmaceutical manufacturers is generally limited to at most a few different pill sizes.

Many pills have a disc shape, and are often scored in the middle to allow the pill to be easily split in half, in the event that the patient only requires half the dosage provided by the pill. Such pills are easy to split, and many of the commercially available pill splitters, commonly sold in drug stores, are specifically designed for use with such disc-shaped pills.

However, many pills do not provide for such ease of splitting. Furthermore, some manufacturers make pills which appear to be designed to be difficult to split. The Viagra® pill, for example, has a plan view which is substantially diamond shaped, with rounded points. In side elevation view, the Viagra® Pill is not rectangular, as are most pills, but has a mid section substantially larger than the ends, and further curved as well. The pill is further coated with a substance which clings to the inner material.

In attempting to split the Viagra® pill with a knife while holding the pill on a flat surface, it is found first that it is difficult to stabilize the pill because of the relatively small area in contact with the surface. The shape of the Viagra® pill in reaction to the pressure of the knife causes the pill to tend to slip, or squirt away.

Attempts were made to use a variety of commercially available pill cutters, but one of these were effective with the Viagra® pill due to its unusual shape, and also because of the coating used.

It has been found that an essential element of a pill cutter effective on the Viagra® pill is a bed to hold the pill which conforms to the shape of the pill, giving support over substantially the entire lower surface of the pill, and restraining it from slipping in response to cutting pressure exerted by the blade of the splitter.

In addition, it has been found that by concentrating the pressure from the opposite side of the blade, a pill cutter design is provided which only requires a single blade, unlike most commercially available pill cutters. The single blade of the present invention has the added advantage that it is less likely to cause accidents than the handling of a cutter which has an exposed blade on the upper cutting arm.

The present invention is simple to manufacture, and compact, so that it is easy to transport in a pocketbook or pocket. It is simple to use, and reliably cuts the pills for which it is designed, repeatedly making a clean cut in the center of the pill .

SUMMARY OF THE INVENTION

It is an object of present invention to provide a pill splitter which will split pills of complex shapes, and which are resistive to splitting by prior art devices.

It is a further object of the current invention to provide such a device which is inexpensive, compact, easy to operate, and safe to use.

In accordance with one aspect of the invention, the pill splitter includes a bed which conforms to the bottom portion of the pill to be split, maintaining it firmly in position to be split.

In accordance with a second aspect of the invention, the pill splitter has a single blade which engages the pill from below along its length.

In accordance with a third aspect of the invention, a plunger is included which strikes the top portion of the pill along the same line as the blade below.

In accordance with a fourth aspect of the invention, the plunger has one or more guides which engage guide slots located on the upper body of the pill splitter.

In accordance with a fifth aspect of the invention, a clearance slot is located on either side of the blade where it engages the pill.

In accordance with a sixth aspect of the invention, the plunger has a substantially planar form, sharpened at the end which engages the top of the pill, so that the forces on the pill are concentrated where the blade engages the pill from below, and directly above the blade, where the plunger engages the pill.

In accordance with a final aspect of the invention, the upper body of the pill splitter is substantially cylindrical in form.

BRIEF DESCRIPTION OF DRAWINGS

These, and further features of the invention, may be better understood with reference to the accompanying specification and drawings depicting the preferred embodiment, in which.

DESCRIPTION OF THE PREFERRED EMBODIMENTS

Figure 5:
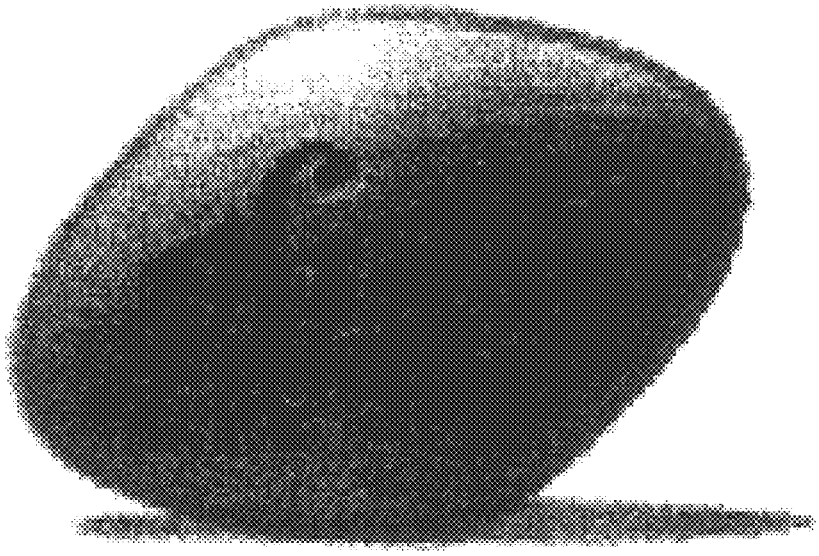
Fig. 5 (Prior Art)
FIG. 5 depicts a perspective view of the Viagra® pill (prior art).

The current invention is particularly effective in the case of pills which have complex shapes, and are not simple discs, with or without scoring in the center. The preferred embodiment is intended to split the Viagra® pill, manufactured by Pfizer Inc. This pill has a complex shape, being substantially diamond shaped, as shown in FIG. 5 and being tapered at either end.

This complex shape makes it difficult, if not impossible, to split with standard pill splitters. In addition to its complex shape, the Viagra® pill also has an exterior coating which further complicates attempts to split the pill, as the coating clings to the material underneath, and causes the pill to either resist splitting, or to crumble in response to attempts to split it.

Figure 3:
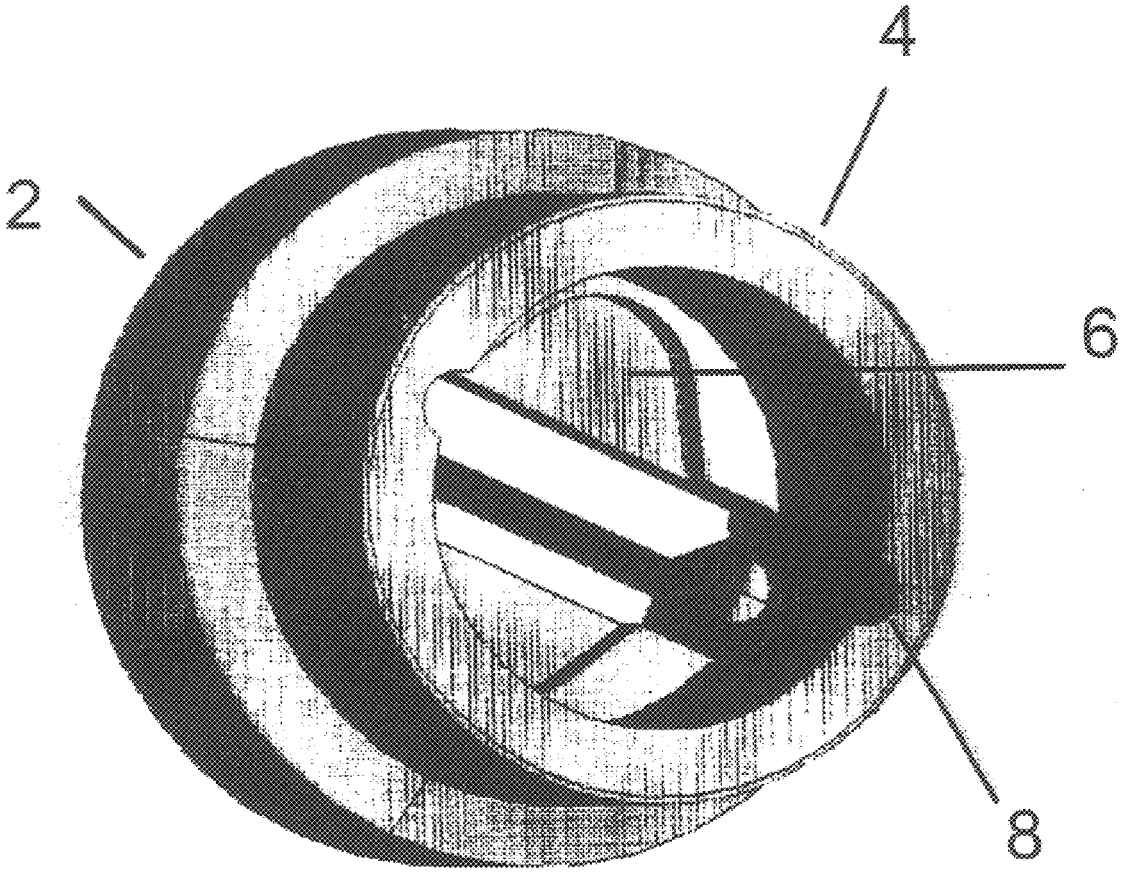
FIG. 3 depicts a perspective view of the pill splitter body, revealing the pill bed.

One of the keys to splitting such a complex shape is to securely support the pill during the splitting operation. This is accomplished in the present invention by forming a bed corresponding to the shape of the pill to be split in three dimensions. Referring now to FIG. 3, the bed 6 is seen to have the substantially diamond shape of the Viagra® pill in a horizontal axis, and is further tapered at the ends in a vertical axis.

Figure 4B:
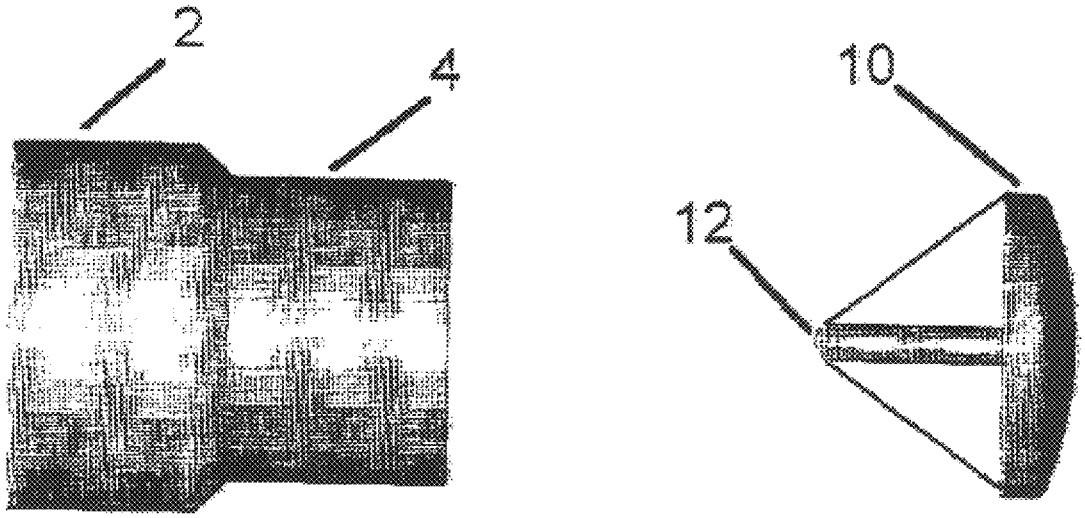
FIG. 4*b* depicts a side elevation view of the pill splitter with the plunger inserted into the body.
Figure 4A:
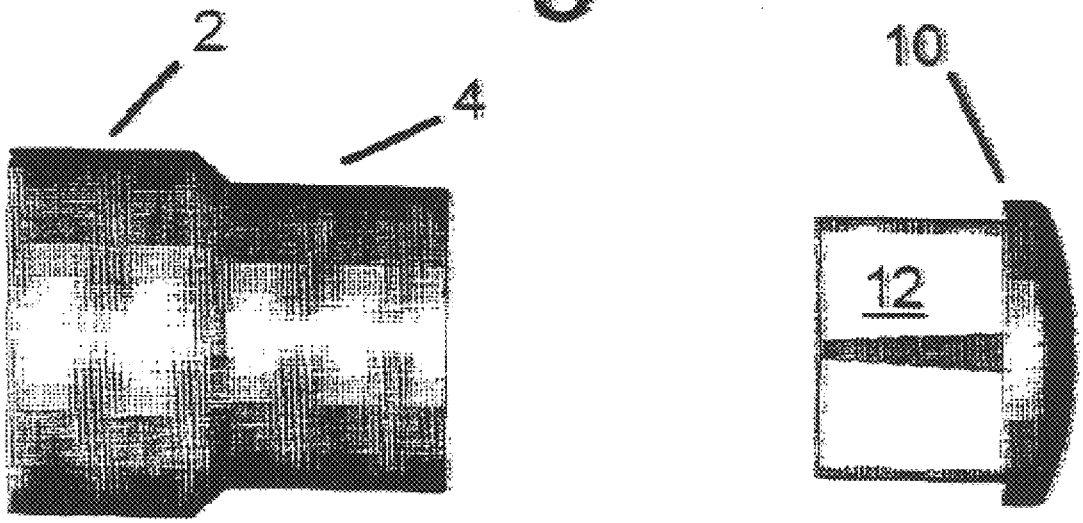
FIG. 4*a* depicts a side elevation view of the pill splitter with the plunger removed from the body.

The bed is affixed within the splitter lower body 2, which is cylindrical in this embodiment, and is integrally attached to the upper body 4, which contains opposing guide slots 8. This figure presents a foreshortened view of the body, because of the angle of view. FIGS. 4*a* and 4*b* present a side elevation view of the splitter bodies 2, 4, and further show the plunger, which consists of a plunger head 10, and plunger body 12, which aligns with the guide slots 8 of the splitter body.

Figure 2:
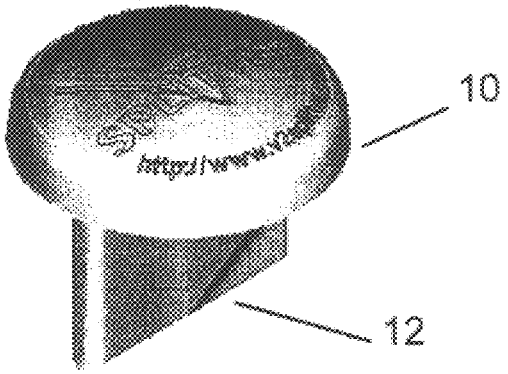
FIG. 2 depicts a cut-away perspective view of the pill splitter, with the plunger inserted into the body.
Figure 1:
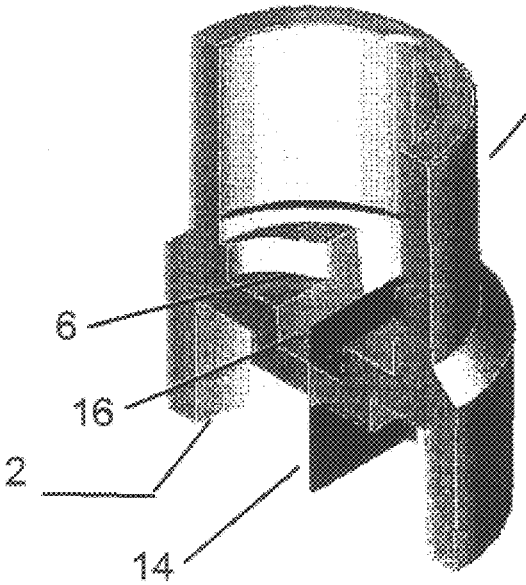
FIG. 1 depicts a cut-away perspective view of the pill splitter, with the plunger removed from and appearing above the body.
Figure 1:
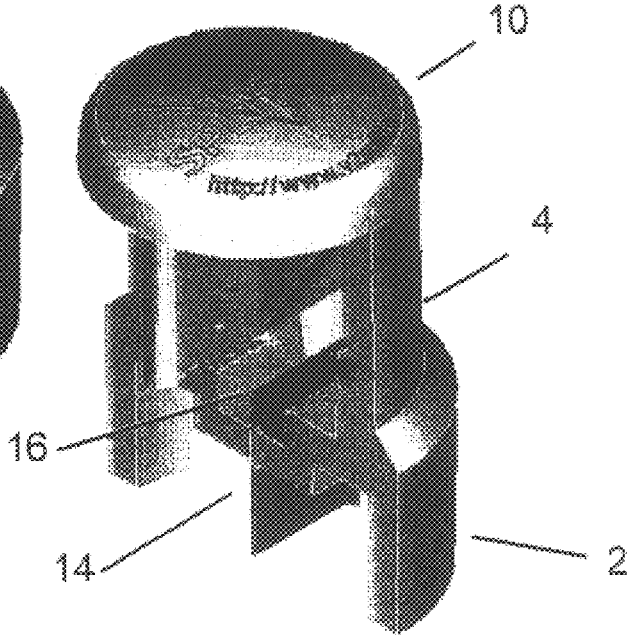

FIGS. 1 and 2 show a perspective cut-away view of the splitter. FIG. 1 shows the splitter with the plunger removed and above the splitter body. FIG. 2 shows the plunger inserted in the body.

These figures show the surgical steel cutting blade 14, which is permanently affixed within the lower body 2. The bed channel 16 provides room for the cutting edge of the cutting blade to engage the pill as the plunger is lowered.

In practice, the pill to be split is placed in the bed. The plunger is then engaged in the guide slots, and the plunger lowered until the tip of the plunger body 12 touches the pill. The user then strikes the plunger cap 10, either with the palm of the hand, or with a mallet. The force of the blow to the plunger cap drives the pill against the cutting blade, which pierces the coating of the pill, and pushes the center further below the plane of the ends of the pill, causing the pill to split cleanly along the line of the blade.

Figure 6C:
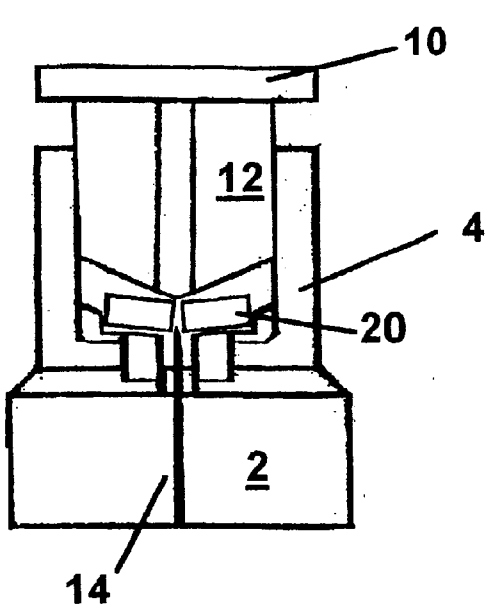
FIG. 6*c* depicts a cross-section view of the pill splitter, with a pill having been split.
Figure 6B:
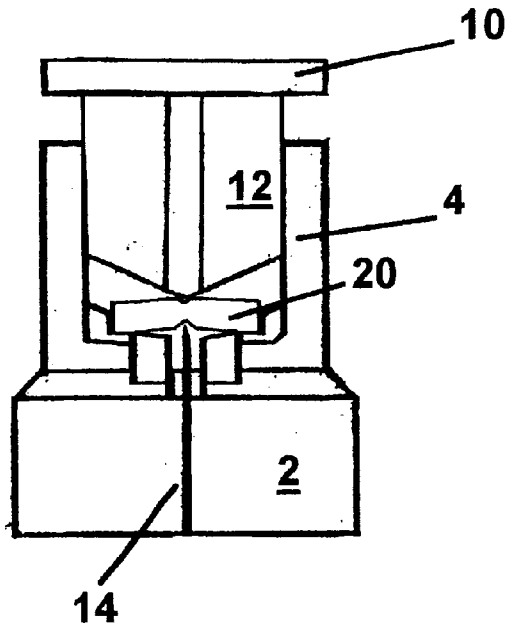
FIG. 6*b* depicts a cross-section view of the pill splitter, with a pill inserted in the bed, and the plunger just beginning its descent and the pill beginning to split.
Figure 6A:
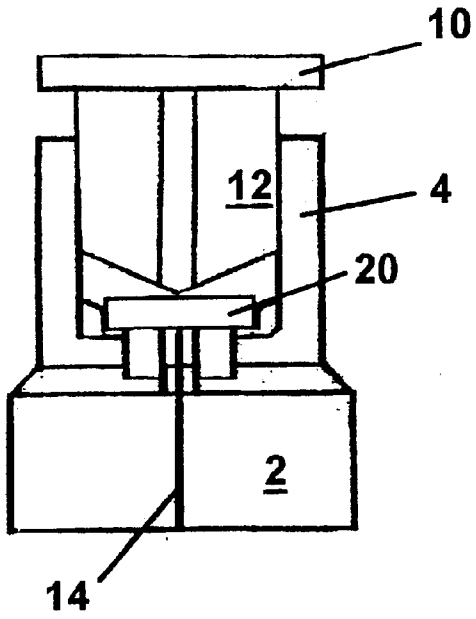
FIG. 6*a* depicts a cross-section view of the pill splitter, with a pill inserted in the bed, and the plunger in contact with the pill.

The process is depicted in FIGS. 6*a*, 6*b*, and 6*c*, which show a pill 20 being progressively split as the plunger descends. In FIG. 6*a*, the pill 20 is in the bed, and the plunger 12 is in contact with the top of the pill, while the point of the blade 14 is in contact with the bottom of the pill. In the next step of the progression, shown in FIG. 6*b*, the user has struck the cap 10 of the plunger, causing the plunger to descend, so that the pill 20 is beginning to split. Because the actual excursion of the plunger is very slight, the change in plunger position in the drawings is not apparent, but the plunger nevertheless moves a small fraction of an inch during the splitting process. In the final drawing, FIG. 6*c*, the blade 14 has penetrated the outer coating of the pill, and the pressure of the plunger and the blade acting on the small area directly between the plunger and blade has caused the pill to split, and the two pieces are shown slightly raised from the bed at the ends of the pill, as a reaction to the impact of the plunger, and as a result of the greater width of the plunger point which contacts the top of the pill.

In contrast to many pill splitters of the prior art, the current invention contains only a single blade, located in the base of the pill splitter. It has been found that the plunger need not contain a blade, so long as the bottom edge of the plunger which strikes the pill is pointed, thus concentrating the force of the blow to the plunger cap directly on the portion of the pill which lies directly above the blade. The current invention thus provides advantages of safety in use, as the single blade is located in the lower body, where the user is much less likely to be cut by the steel blade within.

The material of the pill splitter may be metal, or, preferably, a high-impact plastic, which will withstand the repeated impact to the cap of the plunger used to effect the split.

The present invention is simple to operate, contains only a single moving part, and is compact and easy to carry in a pocket or purse. It uses a single blade, in comparison to the two-blade models of the prior art. In other embodiments, a bed conforming to the shape of other pills makes the invention useful for other such pill configurations.

While the invention has been described with reference to specific embodiments, it will be apparent that improvements and modifications may be made within the purview of the invention without departing from the scope of the invention defined in the appended claims.

I claim:

1. A pill splitter comprising:

a) a bed substantially conforming to the pill shape;

b) a long, thin cutting blade, affixed in proximity to the bed;

c) a lower body containing the bed;

d) an upper body, integrally affixed to the lower body, and containing one or more linear plunger guides slots; and e) a plunger, further comprising plunger guides which slidingly engage said plunger guide slots, so that when the pill is placed into the bed and the plunger is inserted within the upper body, with the plunger guides inserted in the plunger guide slots, and the plunger is struck a sharp blow, the pill is split along the cutting blade.

2. The pill splitter of claim 1, wherein the bed substantially conforms to one half the pill shape in three dimensions.

3. The pill splitter of claim 2, further comprising a clearance slot through which the cutting blade protrudes along its length within the bed.

4. The pill splitter of claim 3, wherein the upper and lower bodies are substantially cylindrical.

5. The pill splitter of claim 4, wherein the plunger further comprises a disc-shaped cap, and a lower plunger body, substantially planar in form, with the edges of the plunger body comprising the plunger guides.

6. The pill splitter of claim 5, wherein the end of the plunger body which contacts the pill is substantially pointed along its length, so that the force of a blow to the plunger cap is concentrated directly above the blade.

7. A method for splitting a medication in the form of a pill, the method comprising:

a) employing a device further comprising a bed substantially conforming to the pill shape, a long, thin cutting blade, affixed in proximity to the bed, a lower body containing the bed, an upper body, integrally affixed to the lower body, and containing one or more linear plunger guides slots, a plunger, and plunger guides affixed to the plunger, and which slidingly engage said plunger guide slots; and b) placing the pill into the bed, inserting the plunger in the plunger guide slots, and rapidly translating the plunger toward the cutting blade.

8. A pill splitter comprising:

a) a bed substantially conforming to the pill shape;

b) a long, thin cutting blade, affixed in proximity to the bed;

c) a lower body containing the bed;

d) an upper body, integrally affixed to the lower body, and containing one or more linear plunger guides slots; and e) a plunger, further comprising plunger guides which slidingly engage said plunger guide slots, constraining the plunger motion to a reciprocating motion, so that when the pill is placed into the bed and the plunger is inserted within the upper body, with the plunger guides inserted in the plunger guide slots, and the plunger is rapidly translated toward the blade, the pill is split along the cutting blade.

* * * * *